United States Patent [19]

Hessey

[11] Patent Number: 4,787,212

[45] Date of Patent: Nov. 29, 1988

[54] AIR CONDITIONER WITH AUTOMATIC SHUTDOWN

[76] Inventor: John C. Hessey, 8570 N.W. 177th St., Miami, Fla. 33015

[21] Appl. No.: 109,711

[22] Filed: Oct. 19, 1987

[51] Int. Cl.[4] ..... F25D 21/02

[52] U.S. Cl. ..... 62/188; 62/128; 62/129; 340/604

[58] Field of Search ..... 62/129, 128, 188, 126, 62/161, 163, 164; 165/11 R; 73/304 R, 304 C; 340/604, 620; 236/94

[56] References Cited

U.S. PATENT DOCUMENTS

| | | | |
|---|---|---|---|
| 2,726,294 | 12/1955 | Kroening et al. | 340/604 X |
| 3,696,362 | 10/1972 | Sieron | 340/620 |
| 4,020,478 | 4/1977 | Hatfield | 340/604 |
| 4,022,598 | 5/1977 | Gucwa, Jr. et al. | 62/164 |
| 4,380,243 | 4/1983 | Braley | 340/604 X |
| 4,464,582 | 8/1984 | Aragaki et al. | 340/604 X |
| 4,633,673 | 1/1987 | Morrison et al. | 62/129 |

*Primary Examiner*—Harry B. Tanner

*Attorney, Agent, or Firm*—Robert M. Schwartz; Edward I. Mates; Allen B. Curtis

[57] ABSTRACT

An air conditioning system for a building including an air conditioner, a thermostat for controlling operation of the air conditioner, and alternating current electrical control means including circuitry for effectively maintaining operation of the air conditioner and wherein said system comprises a relay including a switch normally closed in the absence of adverse presence of water, at least one water sensor functioning as a switch in the presence of water, and a triac including first and second terminals and a gate, said triac preventing flow of current to the relay and permitting flow of current when the gate of the triac receives flow of an electrical current. Flow of current from the first terminal to the second terminal of the triac and then to said relay effectively opens said normally closed switch for automatically interrupting the flow of alternating current to the thermostat and shutdown of the air conditioner for preventing damage to the building upon adverse accumulation of water discharged from the air conditioner.

6 Claims, 3 Drawing Sheets

AIR CONDITIONER WITH AUTOMATIC SHUTDOWN

BACKGROUND OF THE INVENTION

1. Field of the Invention

This invention relates to an air conditioning system including an air conditioner and an electrical control circuit for automatically shutting off the cooling cycle of the air conditioning system should the water of condensation normally formed during the operation of the air conditioner flow other than through the drain provided therefore. This automatic shut-off of the air conditioner prevents damage to various internal structures and furnishings of a house or other structure caused by leakage or other undesirable discharge of water.

2. Description of the Prior Art

Air conditioner appliances including mechanically operable float control means for automatically shutting off the electric current when the primary drain for the air conditioner becomes obstructed is disclosed in U.S. Pat. No. 4,633,673. The utilizating of electric circuitry including water sensing means for shutting off appliances, other than air conditioners, due to the undesirable presence of water is disclosed in U.S. Pat. No. 3,525,902 wherein high voltage electrical equipment is protected from water hazards. Similarly, U.S. Pat. No. 4,418,712 discloses shutting off an automatic clothes washer or dishwasher upon accidental spillage or leakage of water from these appliances. The latter two patents disclose water sensors in the electrical circuitry for triggering the circuit breaker, but have no override circuitry.

SUMMARY OF THE INVENTION

In accordance with one aspect of this invention, there is provided in combination with an air conditioner normally located in a house or other types of structure, a water sensing safety electrical control for automatically and instantaneously interrupting the current to a thermostat thereby shutting off the air conditioner upon sensing of leakage or other undesirable accumulation of water thus preventing damage to interior floor and walls, ceiling of a house, and interior furnishing.

In accordance with another aspect of the invention, there is provided in combination with an air conditioner an improved alternating current electric control circuit for triggering a circuit breaker relay for shutting off the electric current to the thermostat and consequently to an air conditioner and thus preventing further accumulation of water.

In accordance with still another aspect of the invention, there is provided an electrical control system for detecting water leakage occurring as a result of one or more of the following, namely, drain line stoppage, drain pan corrosion and cracks, icing of evaporating coils, water wicking by cabinet insulation, and sweating of the metal cabinet housing the air conditioning system.

In accordance with yet still another aspect of the invention, there is provided electrical circuitry for overriding the electrical shut-off circuitry.

Still other aspects of the invention will become readily apparent to those skilled in the art in light of the following detailed description of the invention.

BRIEF DESCRIPTION OF THE DRAWINGS

One preferred embodiment of this invention is hereafter described with specific reference being made to the following figures in which.

DETAILED DESCRIPTION OF THE INVENTION

Figure 1:
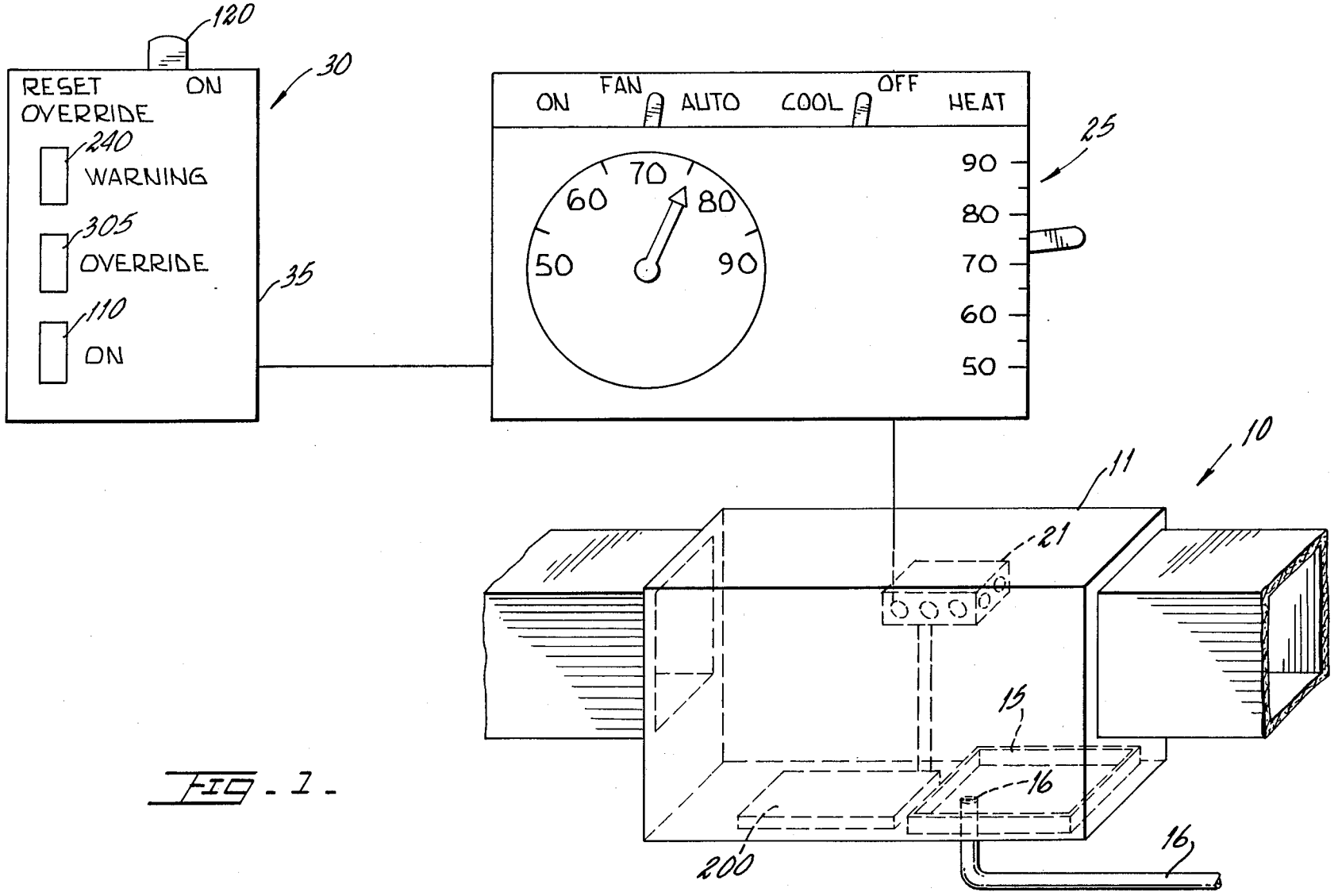
FIG. 1 is a schematic view of an air conditioning system including an air conditioner, thermostat, and an enclosure including electric circuitry therein.

Referring now more specifically to the schematic diagram of FIG. 1, this figure illustrates a conventional air conditioner 10 of the type for normal installation in a house. Housing 11 of the air conditioner includes a water condensation pan 15 including an outlet drain 16, a single electrical water sensor 200, a conventional thermostat 25, a terminal box 21 including a plurality of electrical contacts for operation of the air conditioner, the terminal box being outside the scope of the present invention, and an electric control circuit 30 disposed in a control box 35 having a front panel containing a red warning light emitting diode 240, yellow override 305 and green 110 light emitting diodes (LED), respectively. Control box 35 also includes reset or override switch 120. Control box 35 is so shaped and constructed for mounting on the same wall mounting the thermostat 25 or it can be mounted on the air conditioning unit itself or on any other surface accessible to an operator. As illustrated in FIG. 1 the sensor 200 is located in housing 11 adjacent the drain pan 15. It is within the scope of this invention to utilize more than one water sensor and to locate the water sensor(s) in other areas of the house where leakage of water from housing 11 might possibly occur, for example, in the area immediately below the air conditioner housing where water could leak out at the edges and corners thereof. Because of electrical limitations the water sensor may be located up to about thirty (30) feet from the control box.

Figure 2:
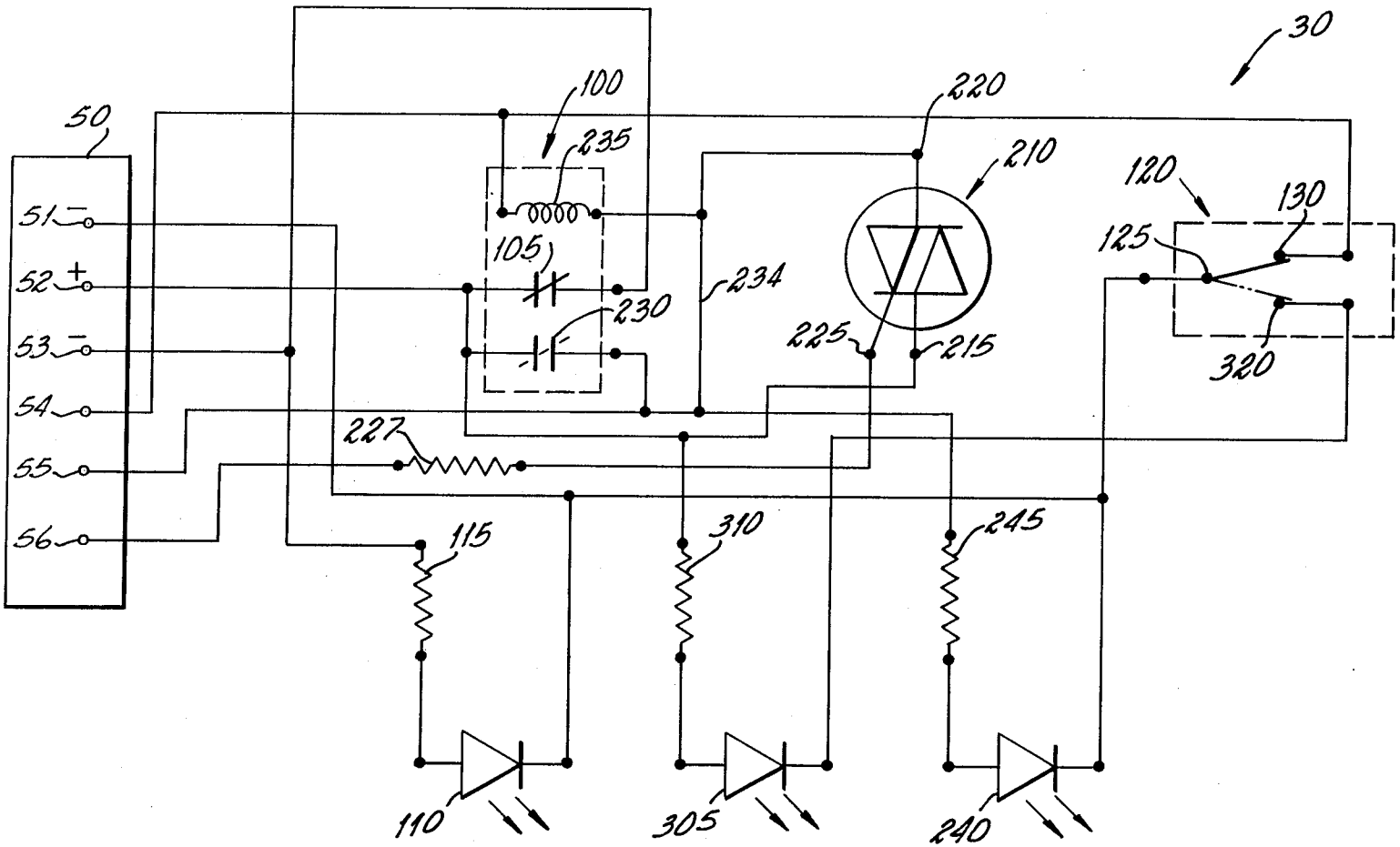
FIG. 2 is an electric control circuit diagram of an interruption circuit for use in combination with an air conditioning system.

Referring now more specifically to FIG. 2, this figure illustrates an electrical control circuit 30 including a normally closed or armed circuitry for maintaining flow of current to thermostat 25 for continued operation of the air conditioner; a normally open or alarm circuitry for inactivating the normally closed circuitry for automatically shutting of the air conditioner upon an undesirable presence of water other than in drain pan 15; and a bypass or override circuitry for overriding the alarm circuitry for again effecting operation of the air conditioner in an emergency, notwithstanding an adverse presence of said undesirable presence of water.

The various components of the air conditioning system are numbered in the numeral "10" series; the various components of the normally closed or armed stage in the "100" series; the open or alarm stage or circuit in the "200" series; and the override stage in the "300" series for facilitating description and understanding of the invention.

The air conditioning system includes electrical control circuit 30, barrier strip 50 including a plurality of terminals 51 through 56, a transformer that is part of the air conditioning system (not shown), the primary coil thereof being connected to a source of alternating current and a secondary coil supplying a 24 volt alternating current power to electrical contacts terminals 51 and 52, terminal 51 being neutral and terminal 52 being the primary side.

The armed or normal stage circuitry of electrical control circuit 30 comprises a double pole single throw relay 100 including a normally closed relay switch 105, green light emitting diode 110, resistor 115 for decreasing the voltage to the green light emitting diode to the operative voltage thereof, and double pole single throw override switch 120 including terminals 125 and 130.

The alarm or shut-down stage of circuit 30 includes electrical water sensor 200 connected to terminals 55 and 56, a six (6) ampere, 400 volt triac 210 (Tandy TM catalog part No. 276-1000) having main triac terminals 215 and 220 and a triac gate 225, a triac resistor 227 of a resistance sufficient for keeping the gate voltage of the triac lower than the terminal voltage on the triac should the water sensor have no resistance, normally open relay switch 230 and excitable coil 235 of relay 100, red light emitting diode 240, and resistor 245.

The bypass or override stage of circuit 30 includes yellow light emitting diode 305, override resistor 310 functioning similarly to resistors 115 and 245, and double pole single throw override switch including override switch terminals 125 and 320.

NORMALLY CLOSED CIRCUIT OR ARMED STAGE

A positive current of 24 volts alternating current flows to terminal 52 and then passes through normally closed switch 105 thereby providing 24 volts of alternating current to thermostat 25 connected to positive terminal 53. Resistor 115 drops the voltage to green light emitting diode 110 for lighting thereof to visually indicate normal operation of the air conditioning system.

ALARM STAGE

The alarm stage includes, in addition to the electrical components discussed above, triac 210 and water sensor 200 which functions similarly to a switch. The triac includes triac terminals 215 and 220 and triac gate 225. Current does not flow from triac terminal 215 to triac terminal 220 when the potential at triac gate 225 is zero or near zero. Thus, current from terminal 52 cannot flow to relay 100 unless an electrical potential is applied to triac gate 225. Wetting of the water sensor 200 produces an output potential by allowing current flow between terminals 55 and 56 and a corresponding voltage increase. When this voltage exceeds about 5.5 volts applied to triac gate 225, there is a flow of current from terminal 52 to triac terminal 215, then to triac terminal 220 of triac 210, and then to excitable coil 235 of relay 100 thereby resulting in energizing or exciting coil 235 and opening of contacts of normally closed relay switch 105. Consequently, no flow of 24 volt current flows to thermostat 25 thereby resulting in automatic shut down of the air conditioner. Current likewise does not flow to green light emitting diode 110. Coil 235 of relay 100 during opening of relay switch 105 also affects closing of contacts of switch 230 thereby allowing flow of current to resistor 245 and red light emitting diode 240 resulting in lighting of this diode for visually indicating undesirable presence of water. Current also flows through normally open contacts of relay switch 230 (now closed) via conductor 234 to excitable coil 235 resulting in interlocking of relay 100 for maintaining normally closed contacts of relay switch 105 open and normally open contacts of relay switch 230 closed for preventing any possible flow of current to the thermostat and restarting of the air conditioner. Current also in this circuitry flows to terminals 54 and 55. Said terminal 54 constitutes an auxiliary contact to which an audio alarm or other remote warning lights may be connected. Terminal 55 is the primary side of this auxiliary circuit.

Wetting of the water sensor usually is caused by condensed water from the air conditioner which at times is prevented from discharging through conduit drain 16, by for example, clogging of the intake of conduit 16 or by overflow of water from pan 15 and possible damage to the internal structure or furnishing of a house. This overflow water contacts and wets water sensor 200. Wetting of the water sensor also can occur from water formed by melting of ice on the coils of the air conditioner, this water dripping into areas other than into pan 15. This wetted sensor 200 functions similarly to a switch.

OVERRIDE CIRCUITRY OR RESET STAGE

Electrical control circuit 30 includes a manually operable double pole single throw reset switch 120 including terminals 125 and 130 for overriding the alarm stage control.

By setting double pole single throw switch 120 in the rest or override position the negative side of relay coil 235 is disrupted thereby allowing normally closed contacts 105 to again close and simultaneously reopening normally open contacts 230 of relay 100. This disruption stops the effect of the interlock and stopping of full current flow to terminal 55 and to red light emitting diode 240.

With reset switch 120 being in the reset position as shown by dotted lines in FIG. 2, terminal 55 receives a voltage through triac gate 225 that will slowly decrease as the water sensor 200 resistance increases during drying thereof. This results in a decrease in the intensity of the red light emitting diode 240. In this override stage current flows to terminal 53 and to yellow light emitting diode 305 and its resistor 310 thereby causing lighting of the yellow light emitting diode 305 indicating overriding of the alarm stage. As shown by the dotted lines of switch 120 in FIG. 2 the neutral side of the yellow light emitting diode 305 is closed thereby providing a complete circuit for the yellow light emitting diode.

RESET CONTROL SWITCH 120

For resetting of control unit 30 after red light emitting diode 240 has gone off, the operator sets double pole single throw switch 120 to an override/reset position and then back to the "ON" position. This will interrupt relay coil 235 of relay 100 and rearm control unit 30.

Figure 3:
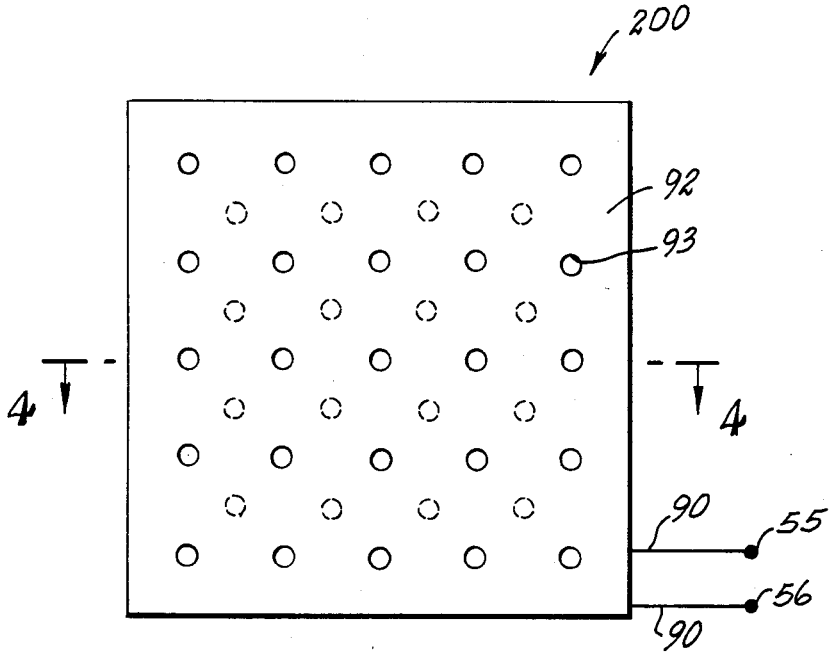
FIG. 3 is a plan view of the water detecting sensor.
Figure 4:
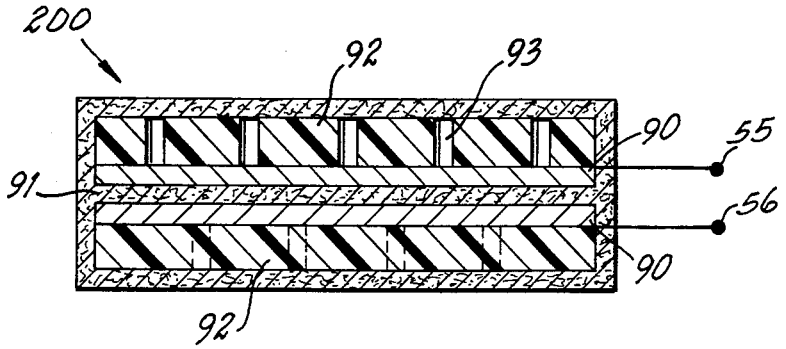
FIG. 4 is a section view of the water sensor taken along line 4—4 of FIG. 3; respectively.

Referring now to FIGS. 3 and 4, these figures illustrate the preferred water sensor means of the invention. Water sensor 200 is a flat type capacitor which includes a pair of spaced flat electrical conductive plates 90, (connected to terminals 55 and 56) for example copper plates, with a porous water permeable insulating material 91 therebetween, such as cotton. The opposed sides of the plates are covered with a porous electrically nonconductive water permeable material 92 formed of, for example, plastic sheets including a plurality of perforations 93. The material of the inner layer 91 may completely encapsulate the exterior of the sensor 200 as illustrated.

It is readily apparent that variations of this invention lie within the reach and capabilities of those skilled in the art without departing from the scope and spirit of the invention, as claimed.

What is claimed is:

1. An air conditioning system subject to undesirable water leakage due to drain line stoppage, and/or drain pan corrosion and cracking, and/or melting of ice formed because of icing of evaporating coils, and/or water wicking by cabinet insulation, and/or sweating of a cabinet housing, said air conditioning system comprising, in combination, an air conditioner, an electric circuit, said circuit including a source of laternating current, a thermostat control means for selectively operating said air conditioner;

a relay including a normally closed relay switch in the circuit to said thermostat control means, a normally open relay switch constructed and arranged to be open when said normally closed relay switch is closed and to be closed when said normally closed relay switch is open, and energizable coil means coupled to said normally closed relay switch and to said normally open relay switch to open said normally closed relay switch and simultaneously close said normally open relay switch when energized, said energizable coil means cooperating with said normally open relay switch when the latter is closed to retain said normally closed relay switch open and said normally open relay switch closed as long as said energizable coil means remains energized from said energization;

at least one water sensing means constructed and arranged for placement in a location likely to contain water due to said undesirable water leakage, said water sensing means permitting flow of alternating current when wet and inhibiting flow of alternating current when dry;

means between said source of alternating current and said energizable coil means for selectively permitting and inhibiting flow of alternating current to said energizable coil means, said means for selectively permitting and inhibiting flow of alternating current to said energizable coil means being responsive to said electric current from said water sensing means, whereby flow of said electric current to said means for inhibiting flow of alternating current to said energizable coil means permits flow of current from said source of alternating current to said energizable coil means to energize said coil means for opening said normally closed relay switch and closing said normally open relay switch to automatically shut down said air conditioner and to retain said normally closed relay switch open and said normally open relay switch closed as long as said coil means remains energized, and a manually operated override switch for de-energizing said energizable coil means to cause said normally open relay switch to resume its normally open position and said normally closed relay switch to resume its normally closed position to enable current to resume to said air conditioner via said thermostat control means when said override switch is manually operated.

2. In an air conditioning system as set forth in claim 1 wherein said means for permitting and inhibiting flow of current is a triac semi-conductor, said triac includes a first terminal, a second terminal, and a gate, said gate permits flow of current from said first terminal to said second terminal and from said second terminal to said coil upon the application of an electrical potential across said second terminal and said gate from said water sensing means.

3. In an air conditioning system as set forth in claim 2 wherein said circuit includes warning means for indicating opening of said normally closed switch and shutting off of said air conditioner.

4. In an air conditioning system as set forth in claim 2, further including a yellow light emitting diode in said circuit for visually indicating said override, and a red light emitting diode in said system for visually indicating the presence of water and shutdown of the air conditioner, the electrical components of said circuit being so selected and positioned in said system that (1) yellow light remains "ON" during the duration of said override, (2) said red light is extinguished upon drying or replacement of said wet water sensor means with dry sensor means, and (3) said normally open switch of said relay is closed and said normally closed switch of said relay is open upon wetting of said water sensor means.

5. In an air conditioning system as set forth in claim 2 wherein said water sensor means comprises a plurality of superimposed layers, said layers including at least a pair of opposed space electrically conductive elements and at least a non-conductive water permeable absorbent material disposed therebetween.

6. In an air conditioning system as set forth in claim 2 wherein said circuit includes means for flow of current through said relay for maintaining said normally closed switch open and said normally open switch closed for preventing flow of current to said thermostat control means of said air conditioner and restarting of said air conditioner

* * * * *